United States Patent [19]

Matsuda

[11] Patent Number: 4,579,270

[45] Date of Patent: Apr. 1, 1986

[54] APPARATUS FOR ATTACHING FASTENER ELEMENTS ONTO A GARMENT

[75] Inventor: Yasuhiko Matsuda, Toyama, Japan

[73] Assignee: Nippon Notion Kogyo Co., Ltd., Tokyo, Japan

[21] Appl. No.: 590,579

[22] Filed: Mar. 16, 1984

[30] Foreign Application Priority Data

Mar. 18, 1983 [JP] Japan ..... 58-39358[U]
Mar. 18, 1983 [JP] Japan ..... 58-39360[U]
Mar. 18, 1983 [JP] Japan ..... 58-39362[U]

[51] Int. Cl.[4] ..... A41H 37/00; A41H 37/04

[52] U.S. Cl. ..... 227/18; 227/15; 227/30; 227/31; 227/107; 227/115; 227/118; 227/119; 227/138; 227/139; 227/149

[58] Field of Search ..... 227/31, 32, 118, 138, 227/139, 149, 15, 18, 115, 119, 53, 30, 107

[56] References Cited

U.S. PATENT DOCUMENTS 669,516 3/1901 Field et al. ..... 227/149
1,787,190 12/1930 Elsner ..... 227/139
1,967,662 7/1934 Clark ..... 227/32
2,261,281 11/1941 Peterson ..... 227/119

FOREIGN PATENT DOCUMENTS 0492877 2/1930 Fed. Rep. of Germany ..... 227/149

*Primary Examiner*—Paul A. Bell
*Assistant Examiner*—Taylor J. Ross
*Attorney, Agent, or Firm*—Hill, Van Santen, Steadman & Simpson

[57] ABSTRACT

An apparatus for attaching a pair of fastener elements onto a garment includes a gripping mechanism for temporarily holding one fastener element and for releasing the latter immediately before a reciprocally punch arrives at the predetermined lowermost position in which the one fastener element is clinched to the other fastener element supported on a die with the garment sandwiched between the fastener elements. The apparatus may comprises a guide mechanism including a chute having a guide track for the passage of the one fastener element, and a speed reducing device disposed in the chute for slowing down the movement of the one fastener element prior to the arrival of the latter at a retaining portion of the gripping mechanism. An overturning device may be provided in the chute for turning over the one fastener element as the latter slides along the guide track.

9 Claims, 25 Drawing Figures

APPARATUS FOR ATTACHING FASTENER ELEMENTS ONTO A GARMENT

BACKGROUND OF THE INVENTION

1. Field of the Invention

The present invention relates to an apparatus for attaching pairs of fastener elements such as snap fasteners, buttons, ornaments or the like onto a garment.

2. Prior Art

In a fastener attaching machine which comprises a reciprocable punch movable toward and away from a die to force one fastener element held above the die by means of a gripper, into clinching engagement with the other fastener element supported on the die with a garment sandwiched between the elements, it is desired to provide plenty of room between the punch and the die or the gripper and the die so that the operator, in placing the other fastener element on the die, will not be hampered by the punch, the gripper or the die. With this arrangement, however, the other fastener element released from the gripper is likely to be displaced from a suitable position with respect to the one fastener element.

SUMMARY OF THE INVENTION

It is therefore an object of the present invention to provide an apparatus capable to attach pairs of fastener elements neatly onto a garment even when there is a relatively wide space between a gripper and a die or a punch and the die.

Another object of the present invention is to provide a fastener attaching apparatus having a gripping mechanism for placing one fastener element onto the other fastener element reliably with accuracy.

According to the present invention, an apparatus for attaching a pair of fastener elements onto a garment includes a die for supporting thereon one fastener element and a gripping mechanism for temporarily holding the other fastener element and for releasing the latter immediately before a reciprocable punch arrives at the predetermined lowermost position in which the other fastener element is clinched to the one fastener element with the garment sandwiched between the fastener elements. The gripping mechanism comprises a slide bar reciprocably supported on a frame of the apparatus and urged away from the die by a first spring means, and a pair of grip fingers pivotably connected to the slide bar and having a pair of free ends, respectively, disposed above the die and jointly constituting a retaining portion for holding therein the other element, the free ends being urged toward one another by a second spring means. A cam plate is operatively connected to the punch for reciprocation therewith and is engageable with a pair of opposed projections on the respective fingers to move the slide bar toward the die against the bias of the first spring means until the movement of the slide bar is limited by a stop means and then to urge the free ends of the fingers away from one another against the bias of the second spring means, thereby releasing the other fastener element from the retaining portion. The apparatus may comprises a guide mechanism including a chute having a guide track for the passage therethrough of the other fastener element, and a speed reducing device disposed in the chute for slowing down the movement of the other fastener element prior to the arrival of the latter at the retaining portion. An overturning device may be provided in the chute for turning over the other fastener element as the latter slides along the guide track.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
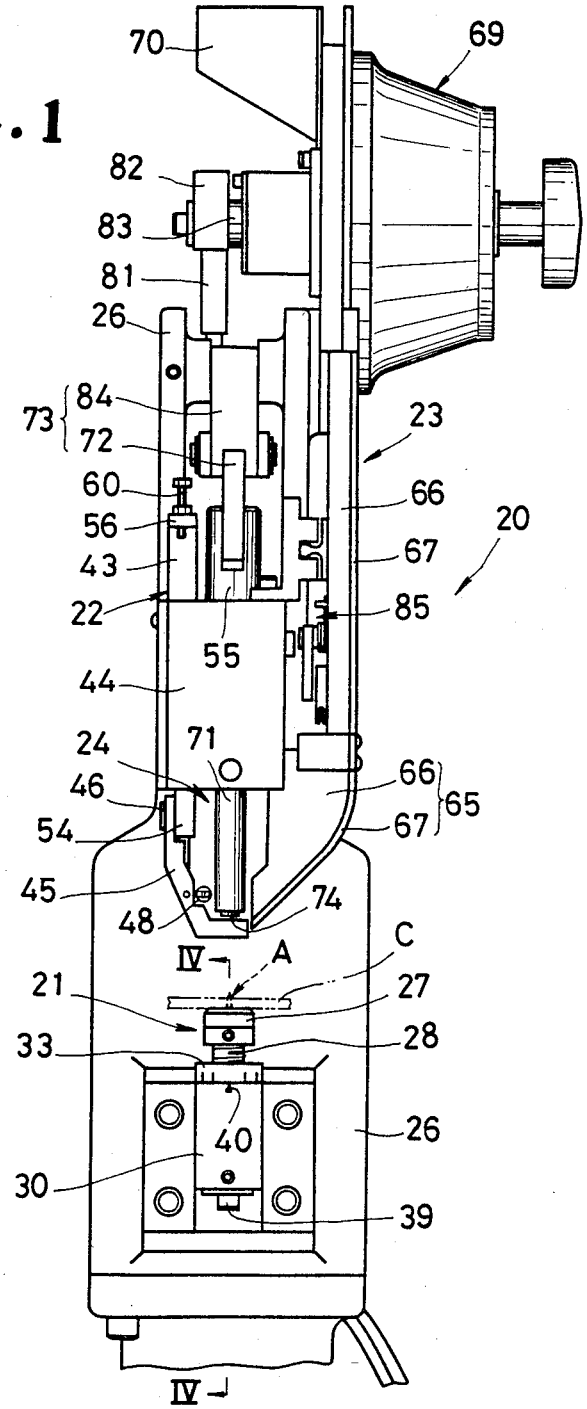
FIG. 1 is a front elevational view of an apparatus according to the present invention.
Figure 2:
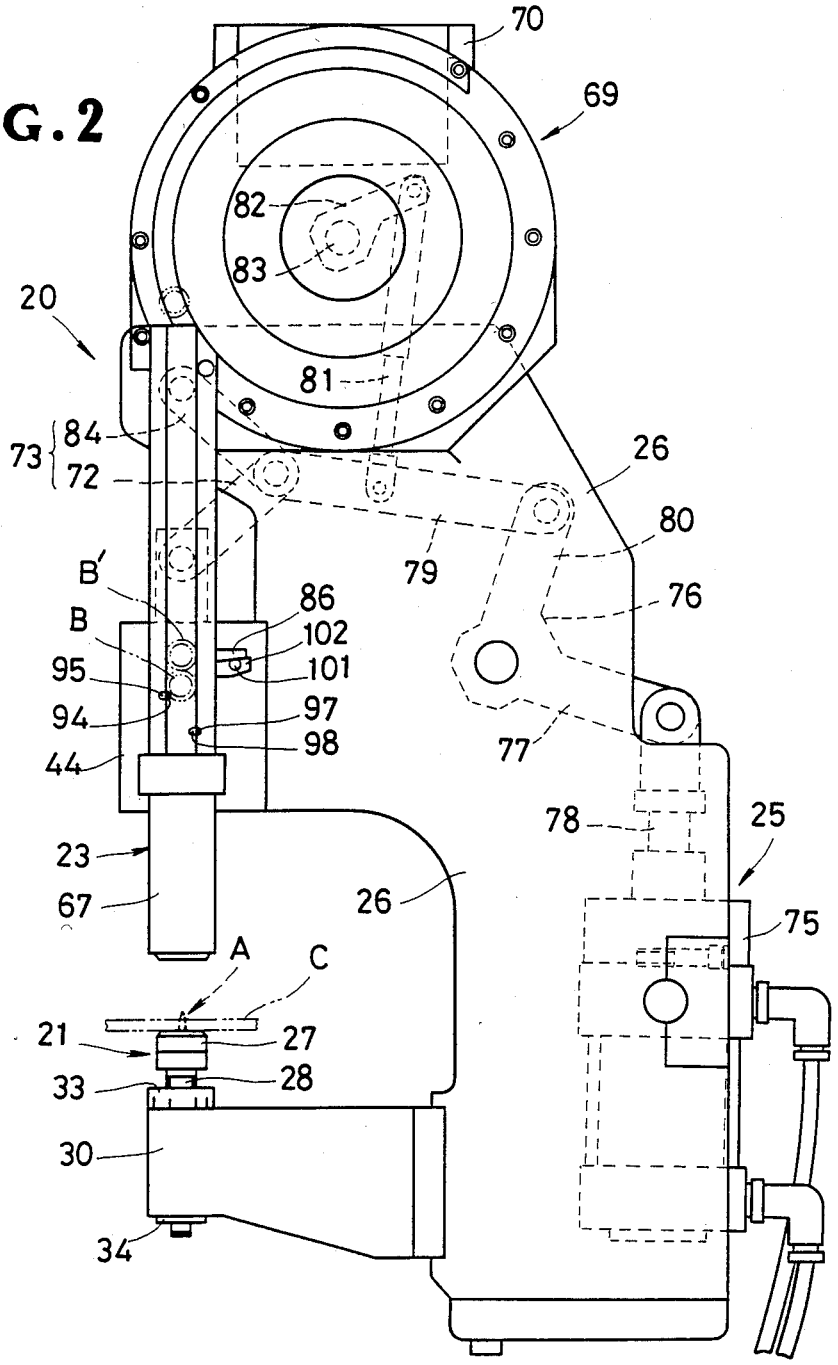
FIG. 2 is a side elevational view of the apparatus.

The present invention is particularly useful when embodied in a fastener attaching apparatus such as shown in FIGS. 1 and 2, generally indicated by the reference numeral 20.

The apparatus 20 is used for attaching a female member of a snap button to a garment C, and generally comprises a die mechanism 21 for supporting thereon a tack or button fastener A of the female member, a gripping mechanism 22 for holding a button head B (FIG. 3) of the female member, a guide mechanism 23 for introducing one button head B at a time into a retaining portion of the gripping mechanism 22, a punch mechanism 24 for forcing the button head B which has been released from the retaining portion, against the button fastener A supported on the die mechanism 21, and a drive mechanism 25 (FIG. 2) for reciprocating the gripping mechanism 22 and the punch mechanism 24, in timed relation to one another, with respect to the die mechanism 21, all the mechanisms 21–25 being mounted on a frame 26.

Figure 13:
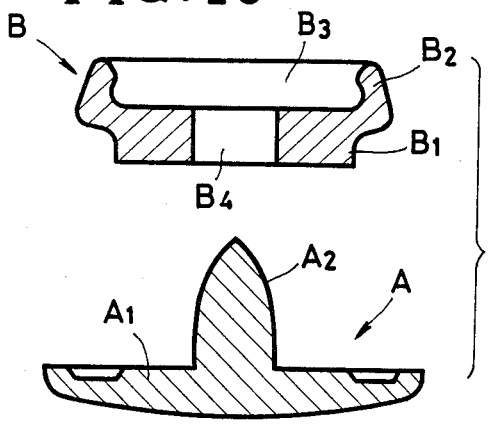
FIG. 13 is an enlarged cross-sectional view of a button head and a button fastener to be clinched together on the apparatus.

As shown in FIG. 13, the button fastener element A includes a circular dish-like base A1 and a shank A2 projecting perpendicularly and centrally from the base A1 and having a pointed end. The button head element B includes a circular base B1 and an enlarged annular socket portion B2 defining therein a circular recess B3 for snappingly retaining the plug of a male member (not shown). The base B1 has a central through-hole B4 through which the pointed shank A2 of the button fastener element A is thrusted to sandwich the garment C (FIGS. 1 and 2) between the bases A1, B1.

Figure 4:
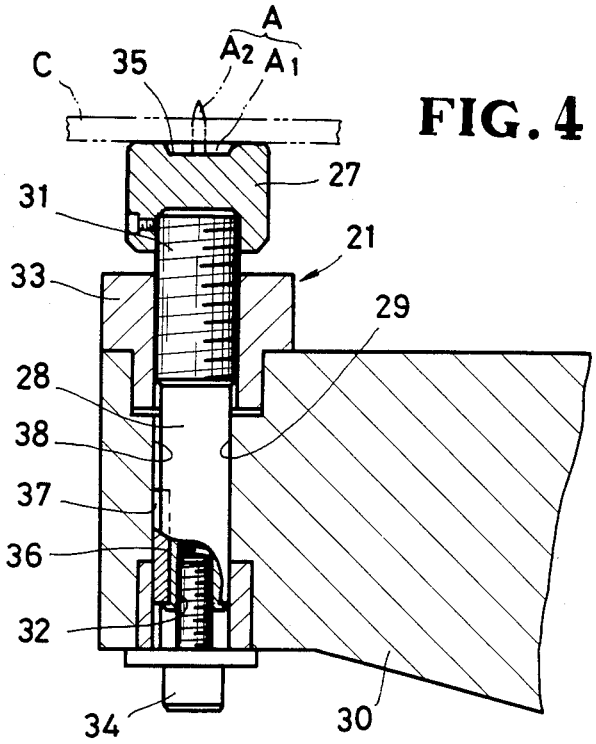
FIG. 4 is an enlarged fragmentary cross-sectional view taken along line IV—IV of FIG. 1.
Figure 5:
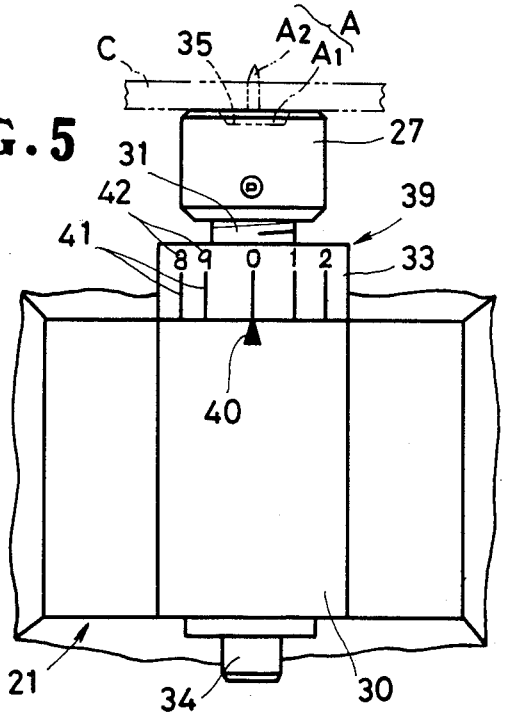
FIG. 5 is a front elevational view of the portion shown in FIG. 4.

As shown in FIGS. 4 and 5, the die mechanism 21 includes a die 27 onto which the button fastener element A is supported, and a support shaft 28 received in a vertical bore 29 extending through a table 30 secured to the frame 26. The shaft 28 has an externally threaded upper portion 31 projecting upwardly from the bore 29, and an internally threaded axial hole 32 opening at one end into the lower end of the shaft 28. An adjustment nut 33 is threaded onto the upper portion 31 of the shaft 28 and a flanged screw 34 is threaded into the hole 32 to thereby secure the shaft 28 to the table 30.

The die 27 is threaded onto the upper end of the shaft 28 and has in its top surface a recess 35 complementary in contour with the base A1 of the button fastener element A. The button fastener element A is manually placed in the recess 35 with its shank A2 driven through the garment C.

As shown in FIG. 4, the support shaft 28 has an axial key seat 36 holding therein a flat key 37 which also is slidably received in a vertical keyway 38 in the table 30 opening into the bore 29. Thus, the shaft 28 is prevented from rotating about its own axis but it is movable in an axial direction in response to rotation of the adjustment nut 33 while the screw 34 loosened. With this construction, the vertical position of the die 27 can be adjusted. To adjust the position of the die 27 precisely with utmost ease, the die mechanism 21 includes a scale 39 as shown in FIG. 5, which is composed of a reference mark 40 on the table 30 and a series of circumferentially spaced lines 41 and a corresponding number of figures 42 on the peripheral surface of the adjustment nut 33. The reading of the scale 39 indicates the amount of vertical movement of the die 27 corresponding to the amount of angular movement of the adjustment nut 33.

As shown in FIGS. 1, 3, 7 and 8, the gripping mechanism 22 includes a slide bar 43 vertically movably mounted on a support block 44 secured to the frame 26 above the die 27, and a pair of juxtaposed grip fingers 45, 45 pivotably connected at one end to the lower end of the slide bar 43 by means of a pair of pins 46, 46, respectively. The grip fingers 45 are bent into a generally L-shape (FIGS. 1 and 3) and have the respective free ends overlying the die 27 and jointly constituting a recessed retaining portion 47 for holding the button head element B. A tension spring 48 extends between the fingers 45 to urge the free ends of the fingers 45 toward one another, as better shown in FIG. 7. The grip fingers 45 have a pair of opposed trapezoidal projections 49 disposed substantially centrally between the respective pins 46, 46 and the respective free ends of the grip fingers 45. The retaining portion 47 has a pocket 50 for receiving therein the base B1 of the button head element B.

Figure 3:
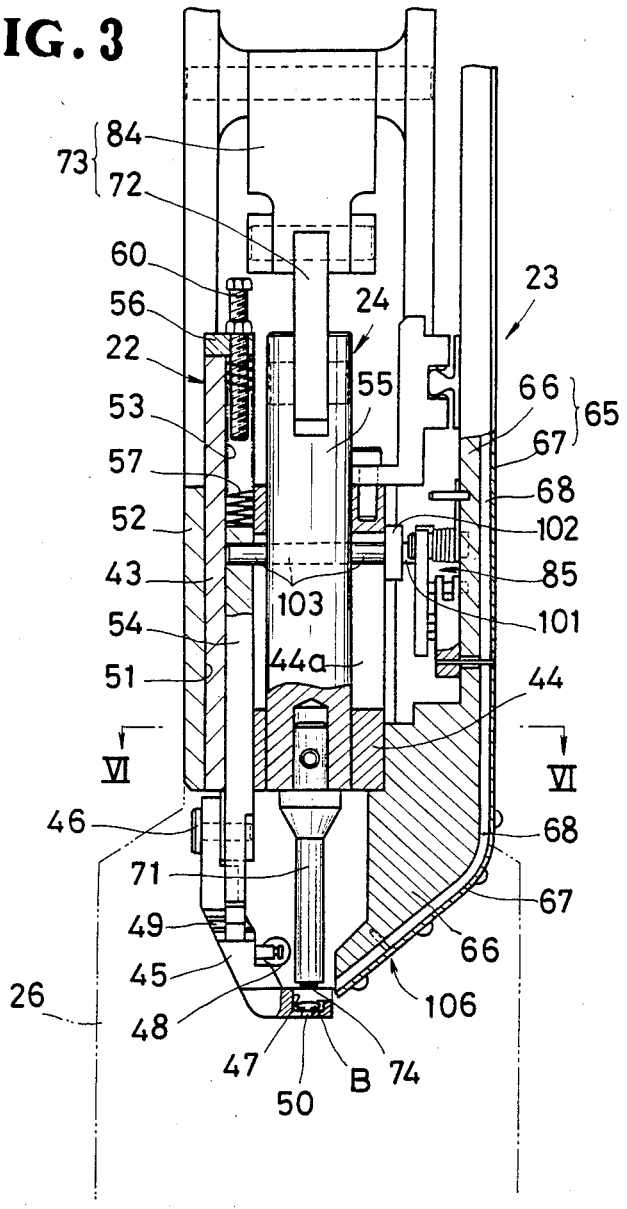
FIG. 3 is an enlarged fragmentary front elevational view, partly in cross section, of a portion of the apparatus.

As shown in FIG. 3, the slide bar 43 is received in a vertical groove 51 in the support block 44, the groove 51 being open at one side. A cover plate 52 is secured to the support block 44 to close the open side of the groove 51, thereby preventing the slide bar 43 from displaced laterally out of the groove 51. The slide bar 43 has a substantially C-shaped cross section (FIG. 6) and defines therein a longitudinal guide channel 53 in which a cam plate 54 is slidably received. The cam plate 54 is connected to a plunger 55 of the punch mechanism 24 (described below in detail) for reciprocation with the plunger 55. An end plate 56 is secured to the upper end of the slide bar 43 and has a pair of extensions projecting laterally from the slide bar 43 in opposite directions. A compression spring 57 is disposed in the guide channel 53 between the end plate 56 and the cam plate 54 to urge the slide bar 43 upwardly away from the cam plate 54. A stud bolt 58 projects from the upper end of the support block 44 and extends upwardly through one extension of the end plate 56. A nut 59 is threaded onto the stud bolt 58 and is normally held in engagement with the upper surface of the end plate 56 to limit the upward movement of the slide bar 43. A headed bolt 60 is threaded through the other extension of the end plate 56 and is engageable with the support block 44 to limit the downward movement of the slide bar 43.

Figure 9:
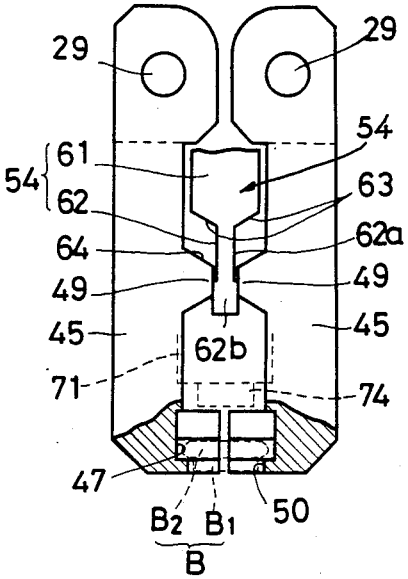
FIGS. 9(A) to 9(C) are enlarged schematic views, partly in cross section, showing successive steps of operation of the gripping mechanism.
Figure 9:
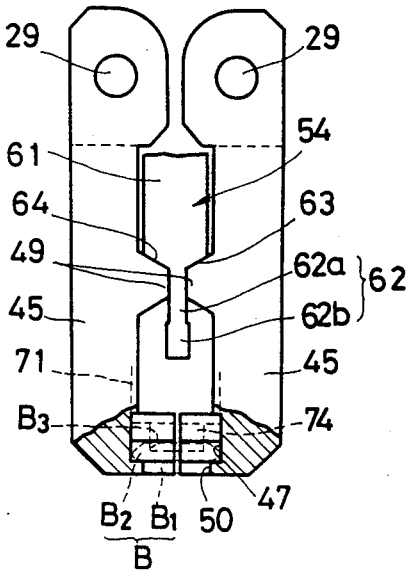
Figure 9:
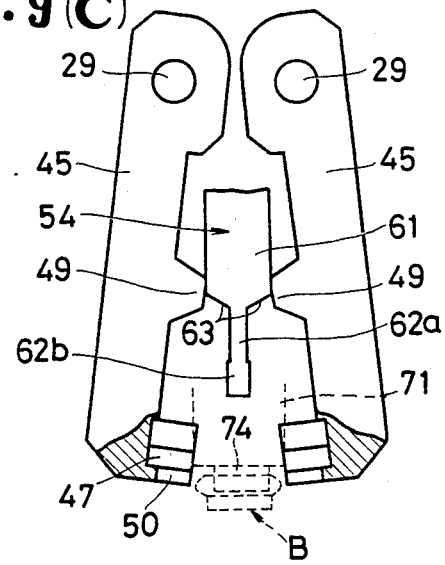

As shown in FIGS. 9(A) to 9(C), the cam plate 54 is disposed between the grip fingers 45 and includes a wide upper portion 61 and a narrow lower portion 62 divided by a pair of beveled surfaces 63, 63 extending respectively to a pair of beveled upper surfaces 64, 64 of the respective projections 49, 49 and having slopes complementary thereto. The lower portion 62 has a neck 62*a* contiguous to the upper portion 61 and a head 62*b* which is slightly wider than the neck 62*a* and which is substantially narrower than the upper portion 61.

Figure 7:
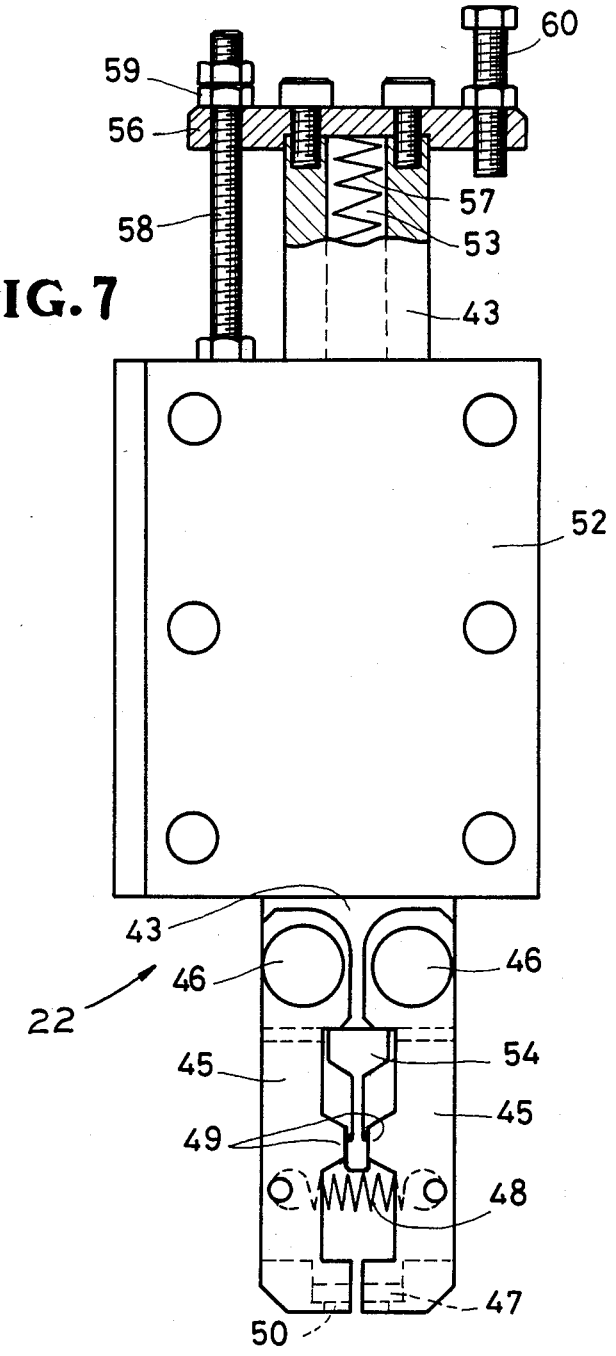
FIG. 7 is an enlarged side elevational view, partly in cross section, of a gripping mechanism of the apparatus.

The gripping mechanism 22 thus constructed operates as follows: When the cam plate 54 is in the retracted position of FIG. 9(A), the head 62*b* engages the projections 49 to slightly spread the retaining portion 47 of the grip fingers 45 against the bias of the tension spring 48 (FIG. 7) so that the button head element B supplied from the guide mechanism 23 can be received smoothly in the spread retaining portion 47 with the base B1 placed in the pocket 50. Downward movement of the cam plate 54 brings the neck 62*a* to engage the projections 49 whereupon the fingers 45 are slightly moved toward one another by the force of the tension spring 48 (FIG. 7) to thereby grip the button head element B in the retaining portion 47. As the cam plate 54 continues to move downwards, the beveled surfaces 63 of the cam plate 54 are brought into fitting engagement with the beveled upper surfaces 64 of the respective projections 49, as shown in FIG. 9(B), and then force the grip fingers 45 and hence the slide bar 43 to descend against the bias of the compression spring 57 until the bolt 60 abuts against the support block 44 to thereby prevent further downward movement of the slide bar 43. During that time, the fingers 45 are urged toward one another at the retaining portion 47 by the tension spring 48 (FIG. 7). When the further downward movement of the slide bar 43 is prevented, the retaining portion 47 of the fingers 45 is held immediately above the button fastener element A placed on the die 27. As the cam plate 54 is moved from the positon of FIG. 9(B) to the extended position of FIG. 9(C) in which the wide upper portion 61 of the cam plate 51 engages the projections 49 of the fingers 45, the beveled surfaces 63 slide along the beveled upper surfaces 64, respectively, to gradually angularly move the fingers 45 away from one another against the bias of the tension spring 48 (FIG. 7), thereby releasing the button head element B from the retaining portion 47. The button head element B thus released falls over the garment C with the shank A2 of the button fastener element A properly received in the hole B4 in the base B1. Thereafter, the cam plate 54 returns from the extended position of FIG. 9(C) through the position of FIG. 9(B) to the retracted position of FIG. 9(A) in which the retaining portion 47 of the fingers 45 is ready to receive the next button head element. Due to a frictional force created between the upper portion 61 and the projections 49 forced thereagainst by the bias of the tension spring 48 (FIG. 7), the fingers 45 are moved upwardly together with the cam plate 54 until the end plate 56 abuts against the nut 59 on the stud bolt 58 (FIG. 7).

Figure 6:
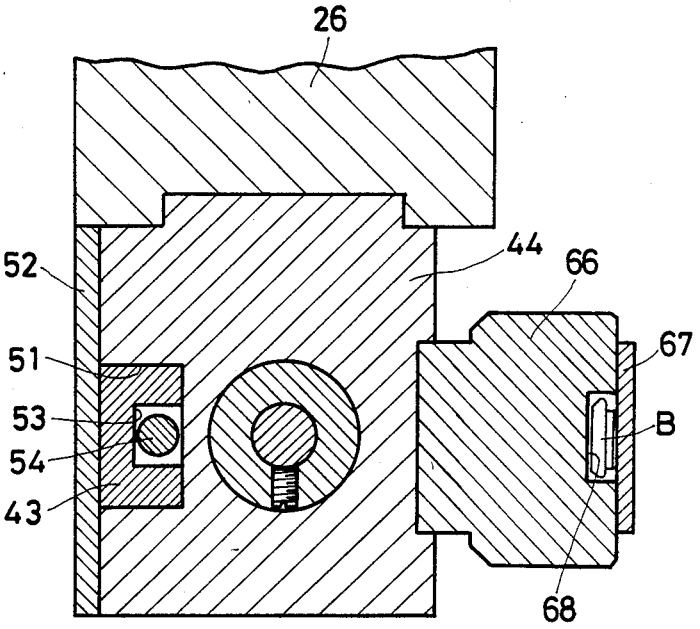
FIG. 6 is a cross-sectional view taken along line VI—VI of FIG. 3.

As shown in FIGS. 1 to 3 and 6, the guide mechanism 23 is disposed on the side of the punch mechanism 24 opposite to the gripping mechanism 22, and it includes a chute 65 comprising a grooved guide block 66 secured to both the support block 44 and the frame 26, and a cover plate 67 secured to the guide block 66 to define therebetween a guide track 68 for the passage therethrough of the button head elements B, the guide track 68 having a rectangular shape in transverse cross section (FIG. 6). The guide track 68 has a vertically extending upper portion and a curved lower portion contiguous to the upper portion and terminating in an outlet facing toward the retaining portion 47 of the fingers 45 which are held in the retracted position of FIG. 3. A parts feeder 69 is secured to the frame 26 and is connected to an upper end of the chute 65 for supplying the button head elements B successively in the guide track 68. The parts feeder 69 has a conventional structure, which utilizes mechanical vibrations created in response to reciprocating movement of the punch mechanism 24, for feeding the button head elements B successively down the chute 65 with the socket portion B2 of each button head element B directed away from the cover plate 67. A hopper 70 is coupled to the parts feeder 69 remotely from the chute 65 for supplying the parts feeder 69 with the button head elements B.

As shown in FIGS. 1 to 3, the punch mechanism 24 includes a punch 71 secured to the lower end of the plunger 55 which extends through the support block 44 in vertical alignment with the die 27. The upper end of the plunger 55 is pivotably connected to the free end of a lower arm 72 of a toggle joint 73. The punch 71 is supported so as to project beyond the lower end of the cam plate 54 and has on its bottom surface a central projection 74 receivable in the recess B3 in the socket portion B2 of the button head element B (FIG. 9(B)).

As shown in FIG. 2, the drive mechanism 25 includes a fluid-actuated cylinder 75 mounted on the frame 26, an L-shaped rocking lever 76 rockably mounted on the frame 26 and having a lower arm 77 pivotably connected to an end of a piston rod 78 of the cylinder 75, a connecting rod 79 pivotably connected at opposite ends to the free end of an upper arm 80 of the rocking lever 76 and the pivot of the toggle joint 73, and a connecting link 81 pivotably connected at opposite ends to the connecting rod 79 and an oscillating lever 82 connected for corotation with a drive shaft 83 of the parts feeder 69. The free end of an upper arm 84 of the toggle joint 73 is journaled on the frame 26. With the drive mechanism 25 thus constructed, reciprocating movement of the piston rod 78 causes the rocking lever 76 to turn or angularly move in opposite directions whereupon the toggle joint 73 is straightened and contracted to reciprocate all of the slide bar 43, the cam plate 54 and the plunger 55. At the same time, the parts feeder 61 is vibrated through the rod 79, the link 80, the lever 82 and the shaft 83.

Figure 10:
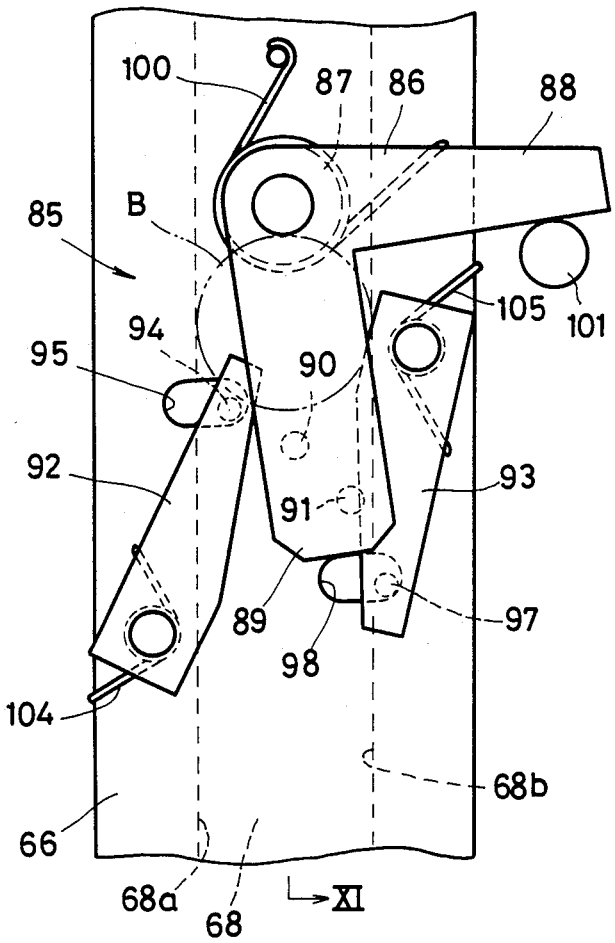
FIG. 10 is an enlarged view of a parts-supply unit of the apparatus.
Figure 11:
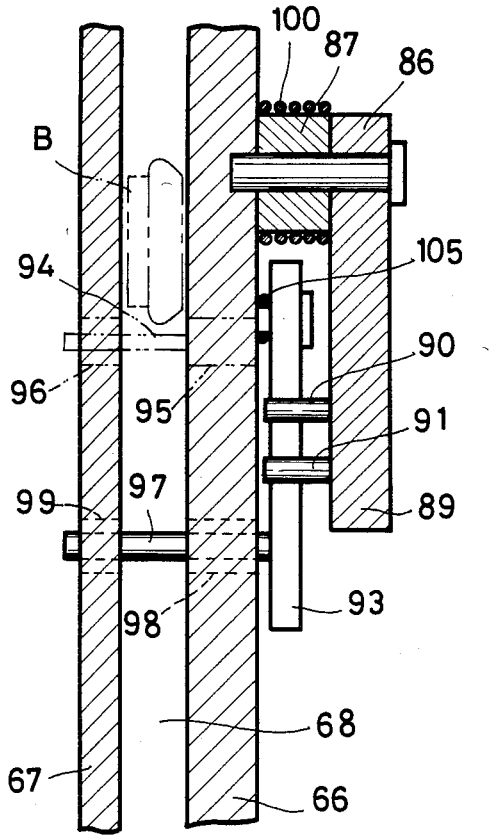
FIG. 11 is a cross-sectional view taken along line XI—XI of FIG. 10.

The guide mechanism 23 further includes a parts-supply unit 85 (FIGS. 1 and 3) assembled with the upper portion of the chute 65 for feeding one button head element B down the guide track 68 to the retaining portion 47 of the fingers 45 each time the punch mechanism 24 completes one cycle of operation. As shown in FIGS. 3, 10 and 11, the unit 85 includes a bell crank 86 pivotably supported on the guide block 66 behind the guide track 68, and a hollow cylindrical spacer 87 interposed between the guide block 66 and the bell crank 86. The bell crank 86 has a horizontal arm 88 extending transversely to the guide track 68 and a vertical arm 89 extending longitudinally of the guide track 68, the vertical arm 89 having a pair of spaced first and second pins 90, 91 projecting perpendicularly from the distal end of the arm 89 toward the guide block 66, as shown in FIG. 11. A pair of first and second pivot levers 92, 93 is disposed one on each side of the vertical arm 89 of the bell crank 86 substantially in parallel relation to one another. The first lever 92 is pivotably connected at the lower end thereof to the guide block 66 and has a first stop pin 94 projecting from the upper end of the lever 92 through a pair of aligned oblong guide holes 95, 96, respectively, in the guide block 66 and the cover plate 67. Likewise, the second lever 93 is pivotably connected at the upper end thereof to the guide block 66 and has a second stop pin 97 projecting from the lower end of the lever 93 through a pair of aligned oblong guide holes 98, 99, respectively, in the guide block 66 and the cover plate 67. The pair of guide holes 95, 96 and the pair of guide holes 98, 99 extend transversely to the guide track 68 across opposed sidewalls 68*a*, 68*b* of the guide track 68, the guide holes 95, 96 being spaced from the guide holes 98, 99 longitudinally of the guide track 68 by a distance substantially equal to the diameter of the annular socket portion B2 of the button head element B.

Figure 8:
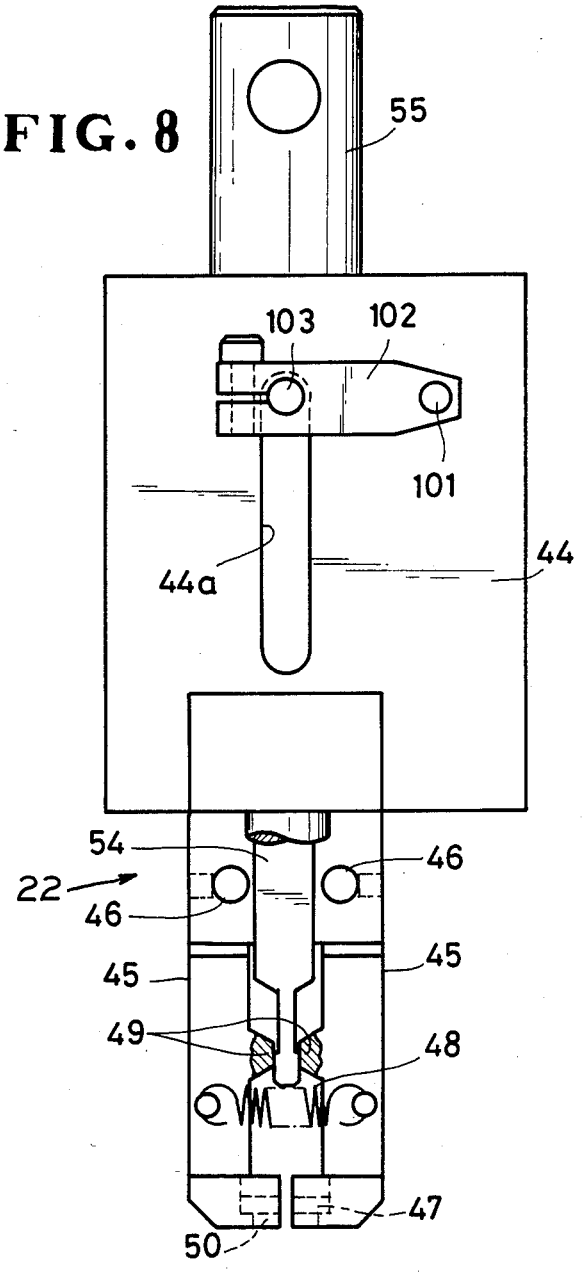
FIG. 8 is a view similar to FIG. 7, showing the opposite side of the gripping mechanism.

A torsion spring 100 is disposed around the spacer 87 and acts between the guide block 66 and the bell crank 86 to urge the latter clockwise in FIG. 10 to thereby bring the horizontal arm 88 into engagement with a rocking or actuating pin 101. As shown in FIGS. 3 and 8, the rocking pin 101 is connected to a horizontal lever 102 secured to a cross pin 103 which extends through a longitudinal groove 44*a* in the support block 44 across the plunger 55 and the cam plate 54 to connect them together. Each of the pivot levers 92, 93 is urged to angularly move toward a corresponding one of the pins 90, 91 by means of a respective torsion spring 104, 105 acting between the lever 92, 93 and the guide block 66. With this arrangement, the stop pins 94, 97 are movable in response to reciprocation of the plunger 55 of the punch mechanism 24, to alternately project into and retract from the guide track 68, thereby releasing one button head element B at a time from the parts-supply unit 85 to the retaining portion 47 of the grip fingers 45.

Timed operation of the parts-supply unit 85 and the punch mechanism 24 is described hereinbelow in detail.

When the punch mechanism 24 is in the retracted or uppermost position (FIG. 3), the unit 85 is held in the position of FIG. 10 in which the first stop pin 94 projects into the guide track 68 to thereby prevent the lowermost button head element B from falling beyond the pin 94. As the punch mechanism 24 is moved from the retracted position toward the extended or lowermost position, the rocking or actuating pin 101 is lowered along the groove 44A (FIG. 8) to cause the bell crank 86 to turn clockwise in FIG. 10 due to the bias of the torsion spring 100 whereupon the second pivot lever 93 turns clockwise under the force of the torsion spring 105 to thereby project the stop pin 97 into the guide track 68. At the same time, the pin 90 on the bell crank 85 forces the first pivot lever 92 to pivot counterclockwise against the bias of the torsion spring 104, thereby retracting the first stop pin 94 from the guide track 68. Thus, the lowermost button head element B is allowed to fall onto the second stop pin 97, as shown in FIG. 12.

Figure 12:
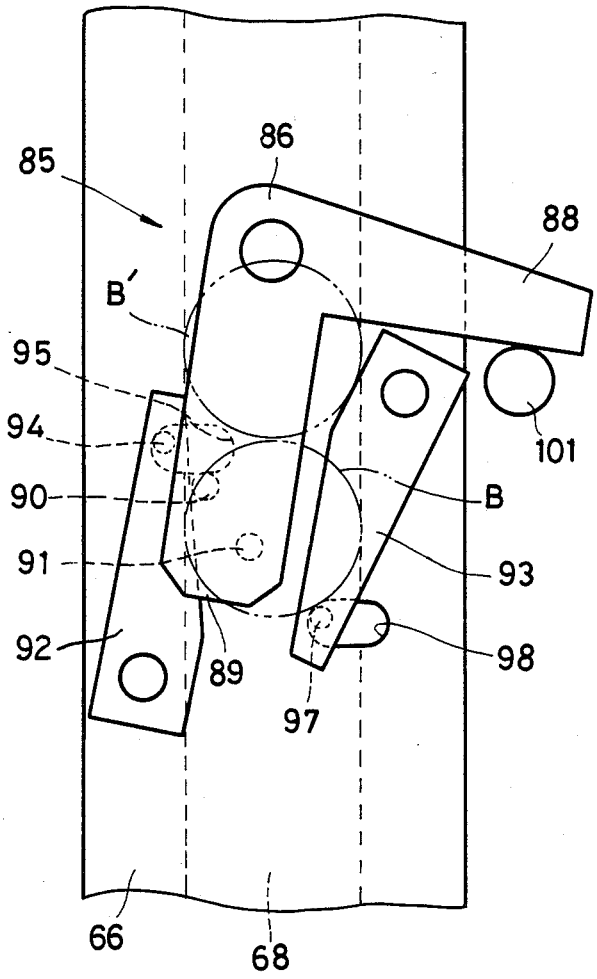
FIG. 12 is a view, with parts ommitted for clarity, similar to FIG. 10, showing the unit in a different position.

The punch mechanism 24 then is returned to the retracted position, during which time the bell crank 85 is turned counterclockwise in FIG. 12 by the rocking or actuating pin 101 against the bias of the torsion spring 100 (FIG. 10). This movement of the bell crank 85 causes the pivot levers 92, 93 to pivot clockwise and counterclockwise, respectively, in FIG. 12 with the result that the lowermost button head element B is released from the unit 85 as the stop pin 97 is retracted from the guide track 88 while the succeeding button head element B′ is prevented by the stop pin 94 from moving beyond the latter. Thus, the button head element B are supplied from the unit 85 to the retaining portion 47 of the grip fingers 45 one at a time, each time the punch mechanism 24 completes one cycle of reciprocation.

In operation, the cylinder 75 is actuated to extend the piston rod 78 whereupon the toggle joint 73 expands its arms 72, 84 to lower the plunger 55, the cam plate 54 and the slide bar 43 toward the die 27. The cam plate 54 controls the grip fingers 45 to release the button head element B from the retaining portion 47 onto the button fastener element A supported on the die, immediately before the punch 71 reaches the lowermost position in which the button head element B and the button fastener element A are clinched together with the garment C sandwiched therebetween. During that time, the bell crank 86 and the pivot levers 92, 93 of the parts-supply unit 85 pivot to allow the lowermost button head element B to move downwards by its own weight by a distance substantially equal to the maximum diameter of the button head element B. When the cylinder 75 is actuated to retract the piston rod 78, the toggle joint 73 contracts its arms 72, 84 to move the plunger 55, cam plate 54 and the slide bar 43 away from the die 27. The grip fingers 45 return to a position ready to receive the succeeding button head element in the slightly expanded retaining portion 47, and the bell crank 86 and the pivot levers 92, 93 pivot to allow the lowermost button head element to slide along the guide track 68 to the retaining portion 47.

The apparatus 20 constructed in accordance with the invention has the following advantages: Since the grip fingers 45 and the punch 71 are operatively connected together to reciprocate in timed relation to one another such that they release the button head element B immediately before the punch 71 reaches the lowermost position, the button head element B thus released is properly set on the button fastener element A supported on the die 27. The gripping mechanism 22 operates reliably and is simple in structure because reciprocation and opening and closing of the grip fingers 45 are controlled by the springs 48, 57 and the cam plate 54 operatively connected to the punch 71 for reciprocation therewith.

Figure 14:
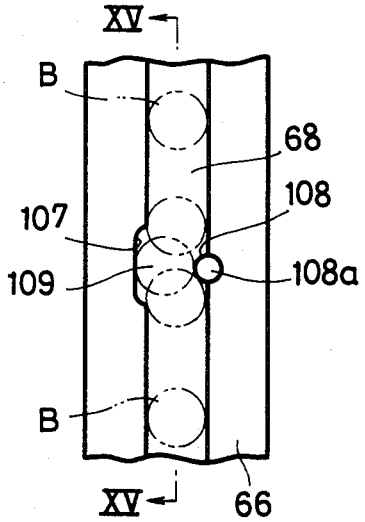
FIG. 14 is an enlarged fragmentary view, with parts ommitted for clarity, of a speed reducing device of the apparatus.
Figure 15:
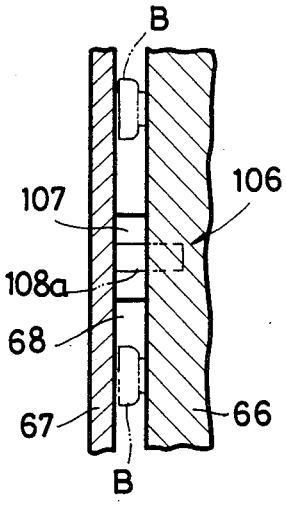
FIG. 15 is a cross-sectional view taken along line XV—XV of FIG. 14.

The apparatus 20 may include a speed reducing device 106 (FIG. 3) for slowing down sliding movement of the button head element B prior to the arrival of the same at the retaining portion 47 of the grip fingers 45. The device 106 is disposed in the chute 65 near the outlet of the guide track 68. As shown in FIGS. 14 and 15, the device 106 comprises a recesses 107 and an opposed projection 108 facing to the guide track 68 to define therebetween an offset passage 108 which is wide enough to allow the button head element to pass therethrough. The recess 107 extends in the same plane as the guide track 68, and the projection 108 is provided by an exposed portion of a pin **108*a* partly embedded in the guide block 66 and extending between the guide block 66 and the cover plate 67**.

With this arrangement, the button head element B supplied from the parts-supply unit 85 (FIG. 3) is displaced laterally (leftward in FIG. 14) into the recess 107 upon impinging engagement with the projection 108, then advances along the offset passage 109, then is again displaced laterally (rightward in FIG. 14) from the recess 107 into the guide track 68. During that time, the speed of downward movement of the button head element B is reduced to an extent that the button head element B enters and then is received in the retaining portion 47 of the grip fingers 45 without tilting in the retaining portion.

Figure 16:
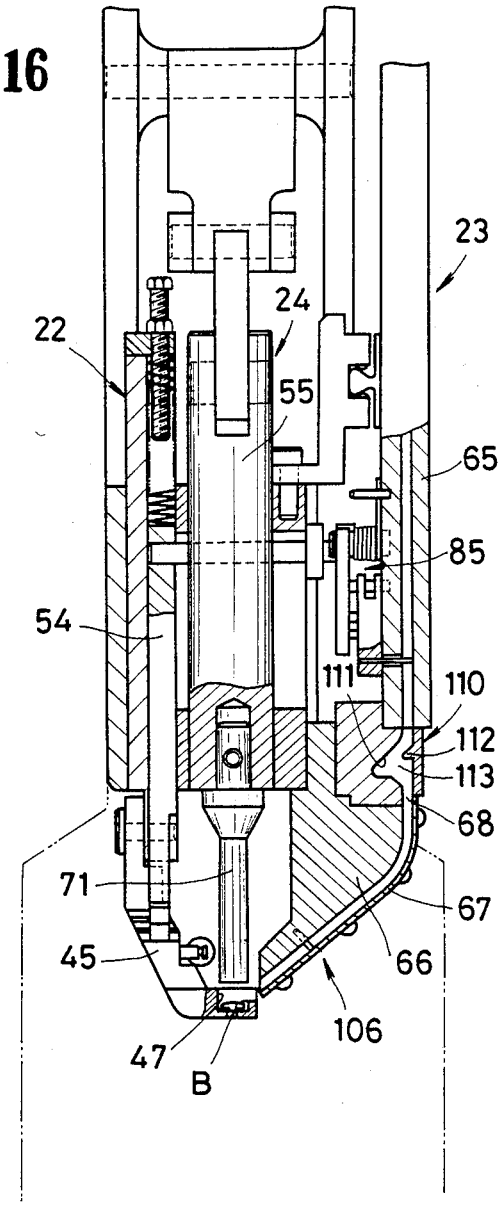
FIG. 16 is a view similar to FIG. 3, showing a modification of the apparatus.
Figure 17:
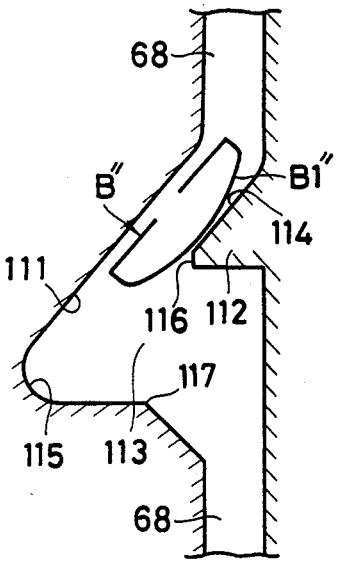
FIGS. 17(A) to 17(E) are enlarged schematic explanatory views showing how an overturning device works.
Figure 17:
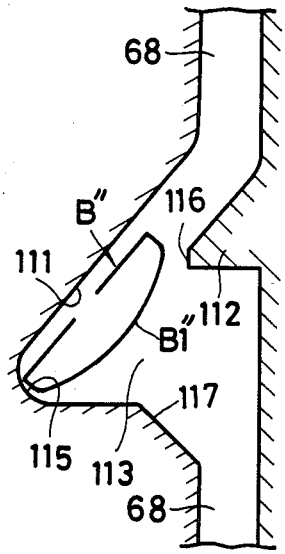
Figure 17:
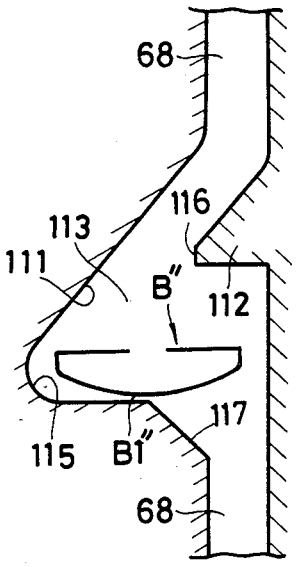
Figure 17:
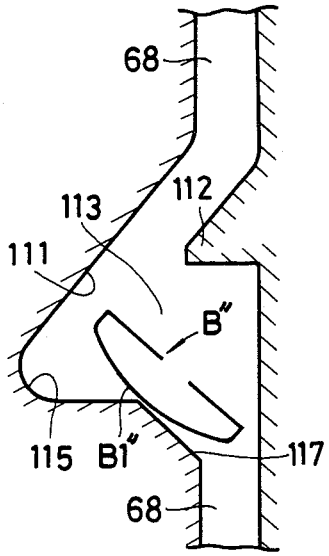
Figure 17:
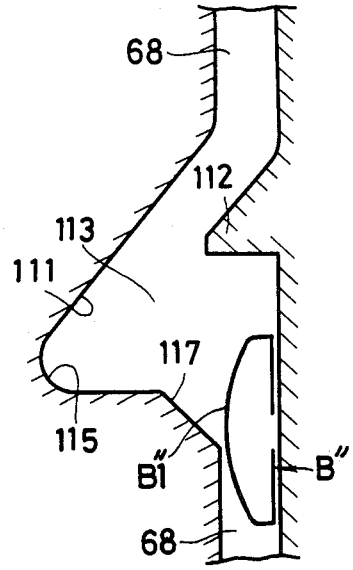
Figure 18:
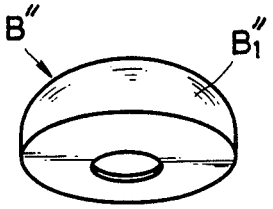
FIG. 18 is an enlarged perspective view of a cap to be applied by the apparatus shown in FIG. 16.

FIG. 16 shows a modification of the apparatus 20 shown in FIGS. 1 to 3. The modified apparatus includes an overturing device 110 disposed in the chute 65 between the parts-supply unit 85 and the speed reducing unit 106, for turning over the button head element B (FIG. 13) or a cap-like button head element B″ (FIG. 18) as the latter slides along the guide track 68. The overturning device 110 comprises a recesses 111 and opposed projection 112 extending in a direction perpendicular to the general plane of the guide track 68 to thereby define therebetween a substantially L-shaped overturning passage 113 communicating at opposite ends with the guide track 68. As shown in FIGS. 17(A-)–17(E), the projection 112 has a sawtooth shape in transverse cross section and has a sloped surface 114 facing upstream of the guide track 68, the projection extending beyond the thickness of the guide track 68. The recess 111 is complementary in shape with the sawtooth-shaped projection 112 and has a bottom or root 115 and a guide wall 117 extending downwardly from the root 115, the root 115 being spaced from a top end or crest 116 of the projection by a distance which is larger than the diameter of the button head element B, B″. With this arrangement, the button head element B″ which is supplied from the unit 85 (FIG. 16) down the guide track 68 into the overturning passage 113 with a domed top wall B1″ directed rightward in FIGS. 17(A-)–17(E), first slides along the sloped surface 114 of the projection 112 (FIG. 17(A)), then impinges against the root 115 of the recess 111 due to inertia (FIG. 17(B)), then tilts down against the guide wall 117 by its own weight, then slides along the guide wall 117 on the domed top wall B″, and finally enters the guide track 68 with the domed top wall B1″ directed leftward. Thus, the button bead element B″ is overturned as its passes through the passage 113.

Figure 19:
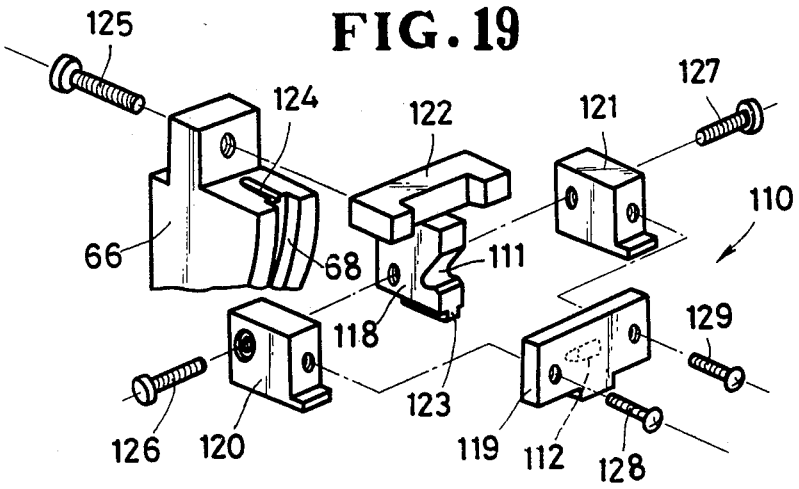
FIG. 19 is an exploded perspective view of an overturning device.

As shown in FIG. 19, the overturning device 110 is constituted by a first block 118 having the recess 111, a second block 119 having the projection 112, a third and a fourth block 120, 121 jointly forming a pair of opposed sidewalls of the overturning passage 113. The first block 118 has a top wing 122 adapted to be fitted with an upper portion of the chute 65 (FIG. 16) and a bottom ridge 123 adapted to be fitted in a groove 124 in the guide block 66 (FIG. 16). For assembly, the first block 118 is secured to the guide block 66 by means of a screw 125, then the second, third and fourth blocks 119–121 are assembled with the first block 118 by means of screws 126–129, thereby defining therebetween the overturning passage 113 (FIG. 16) communicating with the guide track 68.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for attaching a pair of fastener elements onto a garment, comprising:

(a) a frame;

(b) a die mechanism mounted on said frame and having a die for supporting thereon one of the fastener elements;

(c) a gripping mechanism mounted on said frame for releasably holding the other fastener element;

(d) a punch mechanism mounted on said frame and having a reciprocable punch movable toward and away from said die to attach the pair of fastener elements to the garment; and (e) said gripping mechanism including (1) a slide bar reciprocably supported on said frame, said slide bar having a guide channel extending parallel to said punch and closed at one end remote from said die, (2) a pair of grip fingers pivotably connected to one end of said slide bar and having a pair of free ends, respectively, disposed above said die and jointly constituting a retaining portion for holding therein the other fastener element, said fingers having a pair of opposed projections, respectively, (3) a first spring means comprising a compression spring disposed in said guide channel and acting between said slide bar and a cam plate and urging said slide bar away from said die, (4) a second spring means acting between said fingers to urge said free ends toward one another, (5) said cam plate movably received in said guide channel and operatively connected to said punch for reciprocation therewith and engageable with said projections to move said slide bar toward said die against the bias of said first spring means and then to urge said free ends of said fingers away fron one another against the bias of said second spring means, thereby releasing the other fastener element from said retaining portion, and (6) means for limiting movement of said slide bar toward said die.

2. An apparatus according to claim 1, said die mechanism including a table secured to said frame and having a bore extending therethrough, a support shaft connected at one end to said die and received in said bore, said support shaft having an externally threaded portion adjacent to said one end, and an internally threaded axial hole extending from its other end toward said one end of said shaft, an adjustment nut threaded onto said externally threaded portion, a screw threaded in said axial hole to secure said shaft to said table, and a key secured to said shaft to prevent rotation of said shaft.

3. An apparatus according to claim 2, said die mechanism including a scale having a reference mark on said table and a series of lines and a corresponding number of figures on the peripheral surface of said adjustment nut.

4. An apparatus according to claim 1, each said projection having a beveled guide surface sloping toward said die and facing away from said die, said cam plate having a first portion, a second portion narrower than said first portion, and a pair of beveled surfaces dividing said first and second portions, each said beveled surface having a slope complementary to a corresponding one of said beveled guide surfaces.

5. An apparatus according to claim 4, said second portion having a neck extending from said first portion and terminating in a head slightly larger than said neck.

6. An apparatus according to claim 1, including a guide mechanism for guiding the other fastener element into said retaining portion, said guide mechanism including a chute having a guide track for the passage therethrough of the other fastener element, and a parts-supply unit for supplying the other fastener element down said chute to said retaining portion each time said punch completes one cycle of reciprocation.

7. An apparatus for attaching a pair of fastener elements onto a garment, comprising:

(a) a frame;

(b) a die mechanism mounted on said frame and having a die for supporting thereon one of the fastener elements;

(c) a gripping mechanism mounted on said frame for releasably holding the other fastener element;

(d) a punch mechanism mounted on said frame and having a reciprocable punch movable toward and away from said die to attach the pair of fastener elements to the garment;

(e) said gripping mechanism including (1) a slide bar reciprocably supported on said frame;

(2) a pair of grip fingers pivotably connected to one end of said slide bar and having a pair of free ends, respectively, disposed above said die and jointly constituting a retaining portion for holding therein the other fastener element, said fingers having a pair of opposed projections, respectively, (3) a first spring means urging said slide bar away from said die, (4) a second spring means acting between said fingers to urge said free ends toward one another, (5) a cam plate operatively connected to said punch for reciprocation therewith and engageable with said projections to move said slide bar toward said die against the bias of said first spring means and then to urge said free ends of said fingers away from one another against the bias of said second spring means, thereby releasing the other fastener element from said retaining portion, and (6) means for limiting movement of said slide bar toward said die; and (f) a guide mechanism for guiding the other fastener element into said retaining portion, said guide mechanism including (1) a chute having a guide track for the passage therethrough of the other fastener element, (2) a parts-supply unit for supplying the other fastener element down said chute to said retaining portion each time said punch completes one cycle of reciprocation, and (3) a speed reducing device disposed in said chute near the outlet of said chute for slowing down movement of the other fastener element prior to the arrival of the latter at said retaining portion.

8. An apparatus according to claim 7, said speed reducing device comprising a recess extending in the general plane of said guide track and facing toward said guide track, and a projection extending into said guide track in opposed relation to said recess to define therebetween an offset passage communicating with said guide track.

9. An apparatus for attaching a pair of fastener elements onto a garment, comprising:

(a) a frame;

(b) a die mechanism mounted on said frame and having a die for supporting thereon one of the fastener elements;

(c) a gripping mechanism mounted on said frame for releasably holding the other fastener element;

(d) a punch mechanism mounted on said frame and having a reciprocable punch movable toward and away from said die to attach the pair of fastener elements to the garment;

(e) said gripping mechanism including (1) a slide bar reciprocably supported on said frame, (2) a pair of grip fingers pivotably connected to one end of said slide bar and having a pair of free ends, respectively, disposed above said die and jointly constituting a retaining portion for holding therein the other fastener element, said fingers having a pair of opposed projections, respectively, (3) a first spring means urging said slide bar away from said die, (4) a second spring means acting between said fingers to urge said free ends toward one another, (5) a cam plate operatively connected to said punch for reciprocation therewith and engageable with said projections to move said slide bar toward said die against the bias of said first spring means and then to urge said free ends of said fingers away from one another against the bias of said second spring means, thereby releasing the other fastener element from said retaining portion, and (6) means for limiting movement of said slide bar toward said die;

(f) a guide mechanism for guiding the other fastener element into said retaining portion, said guide mechanism including (1) a chute having a guide track for the passage therethrough of the other fastener element, and (2) a parts-supply unit for supplying the other fastener element down said chute to said retaining portion each time said punch completes one cycle of reciprocation; and (g) an overturning device disposed in said chute downstream of said parts-supply unit for turning over the other fastener element, said overturning device comprising (1) a cooperating recess and projection facing toward said guide track and extending in a direction perpendicular to the general plane of said guide track to jointly define therebetween a substantially L-shaped overturning passage, (2) said recess having a root, and (3) said projection having a crest spaced from said root a distance larger than the maximum size of the other fastener element as measured in the longitudinal direction of said guide track.

* * * * *